US006901925B2

(12) United States Patent
Coughlin

(10) Patent No.: US 6,901,925 B2
(45) Date of Patent: Jun. 7, 2005

(54) FIREPLACE WITH WATERFALL

(76) Inventor: David P. Coughlin, 53 Carol St., Buckhannon, WV (US) 26201

( * ) Notice: Subject to any disclaimer, the term of this patent is extended or adjusted under 35 U.S.C. 154(b) by 181 days.

(21) Appl. No.: 10/262,783

(22) Filed: Oct. 1, 2002

(65) Prior Publication Data

US 2003/0084897 A1 May 8, 2003

Related U.S. Application Data

(60) Provisional application No. 60/326,464, filed on Oct. 1, 2001.

(51) Int. Cl.[7] ..... F24B 1/18

(52) U.S. Cl. ..... 126/500; 239/18; 362/96

(58) Field of Search ..... 126/500, 513; 239/17, 18, 15, 20, 23; 222/113; 362/96; 431/253

(56) References Cited

U.S. PATENT DOCUMENTS 2,503,945 A * 4/1950 Grossniklaus ..... 239/23
3,830,217 A * 8/1974 Maness et al. ..... 126/513
4,836,142 A * 6/1989 Duback ..... 239/23
5,092,312 A * 3/1992 Zolow ..... 126/500
2003/0041855 A1 * 3/2003 Grady et al. ..... 126/519
2003/0201336 A1 * 10/2003 Rumens et al. ..... 239/17

* cited by examiner

*Primary Examiner*—Sara Clarke
(74) *Attorney, Agent, or Firm*—Steptoe & Johnson PLLC

(57) ABSTRACT

A fireplace including a fire box having a means for producing flames, a trough positioned in front of or around the fire box, and a hood positioned above the fire box and extending out from the fireplace beyond a front opening in the fire box. Positioned in the trough is a plumbing assembly having a pump and piping for transporting water from the trough upward and through an opening in the hood positioned above the fire box. The hood extends outward beyond the fire box such that water will fall freely in front of the fire box containing the flames and into the trough. One or more nozzles may be connected to the piping near one or more openings in the hood to adjust the trajectory of the water as it falls from the hood.

14 Claims, 2 Drawing Sheets

FIREPLACE WITH WATERFALL

RELATED PRIOR PATENT APPLICATION

This application claims the benefit of U.S. Provisional Application No. 60/326,464, filed Oct. 1, 2001.

BACKGROUND OF THE INVENTION

1. Field of Invention

This invention relates to fireplaces, and more specifically to a fireplace having one or more waterfalls in front of or surrounding a fire.

2. Related Art

Nothing creates a warm and cozy atmosphere like a fireplace. The fireplace is often the focal point of a home, not only because of its capacity to generate heat, but also because it frequently is located in the most often used room in the home whether it be the family room, the living room, or the game room. Because the fireplace is often the focal point of the room in which it is situated, great measures are often taken to beautify the fireplace as much as possible. Fireplaces are often made of beautiful stone or brick, and modern gas fireplaces often contain attractive ceramic logs covering the gas burner. Despite the efforts to enhance the appearance of both indoor and outdoor fireplaces, there are limited means by which one can "upgrade" his or her fireplace.

An attempt to overcome this limitation is described in U.S. Pat. No. 5,092,312 ("the '312 patent"). The '312 patent describes a generally U-shaped area in front of and around the fireplace in which tubing is contained for creating a water fountain. The platform on which the fire burns is situated above the piping that creates the fountain effect. As a result, water spouts upward out of the tubing from holes contained therein, only to fall back into the U-shaped region surrounding the fire burning platform.

While providing an alternative means for decorating a fireplace, the '312 patent is still very limited. The water travels only a very short distance, i.e., from the tubing, upwards a short distance, and back into the U-shaped area. The water does not pass in fron of the flames, nor does it flow from the top of the fireplace to the bottom. As such, there remains a need in the art for yet an alternartive means for creating an aesthetically pleasing fireplace.

SUMMARY OF THE INVENTION

The present invention provides another means by which conventional fireplaces may be made more beautiful. The present invention is a fireplace with a fire box containing a means for producing flames with a method and apparatus for making a waterfall that falls in front of or around the flames.

An aspect of the invention is a fireplace, including a fire box having a front opening and a means for producing flames, a trough positioned in front of the front opening of the fire box, and having a screen positioned horizontally therein, a hood having an opening, and being positioned above the fire box and extending forward a predefined distance in front of the front opening of the fire box such that water falls freely from the opening in the hood into the trough through the screen, and a plumbing assembly connecting the trough with the opening in the hood, wherein the plumbing assembly transports water from the trough to the opening in the hood.

A feature of the invention is a fireplace that allows one to view both a waterfall and a fire at the same time.

Another feature of the invention is a plumbing assembly that transports water from a trough in front of or around a fire box upward to a hood.

An advantage of the invention is that a hood extends out beyond a front opening of a fire box containing a means for producing flames such that water falls freely from the hood into a trough positioned in front of or around the fire box.

Another advantage of the invention is that a screen is positioned in the trough to disperse the water as it falls into the trough from the hood, thereby preventing water from splashing into the fire box.

A feature of the invention is one or more openings in the hood that allow a user to adjust the direction of flow from the hood to the trough.

Another feature of the invention is one or more nozzles connected to the plumbing system near the openings in the hood to adjust the trajectory of the water as it flows from the hood.

BRIEF DESCRIPTION OF THE DRAWINGS

The present invention is described with reference to the accompanying drawings. In the drawing, like reference numbers indicate identical or functionally similar elements. Additionally, the left-most digit of a reference number identifies the drawing in which the reference number first appears.

EMBODIMENTS OF THE INVENTION

Figure 1:
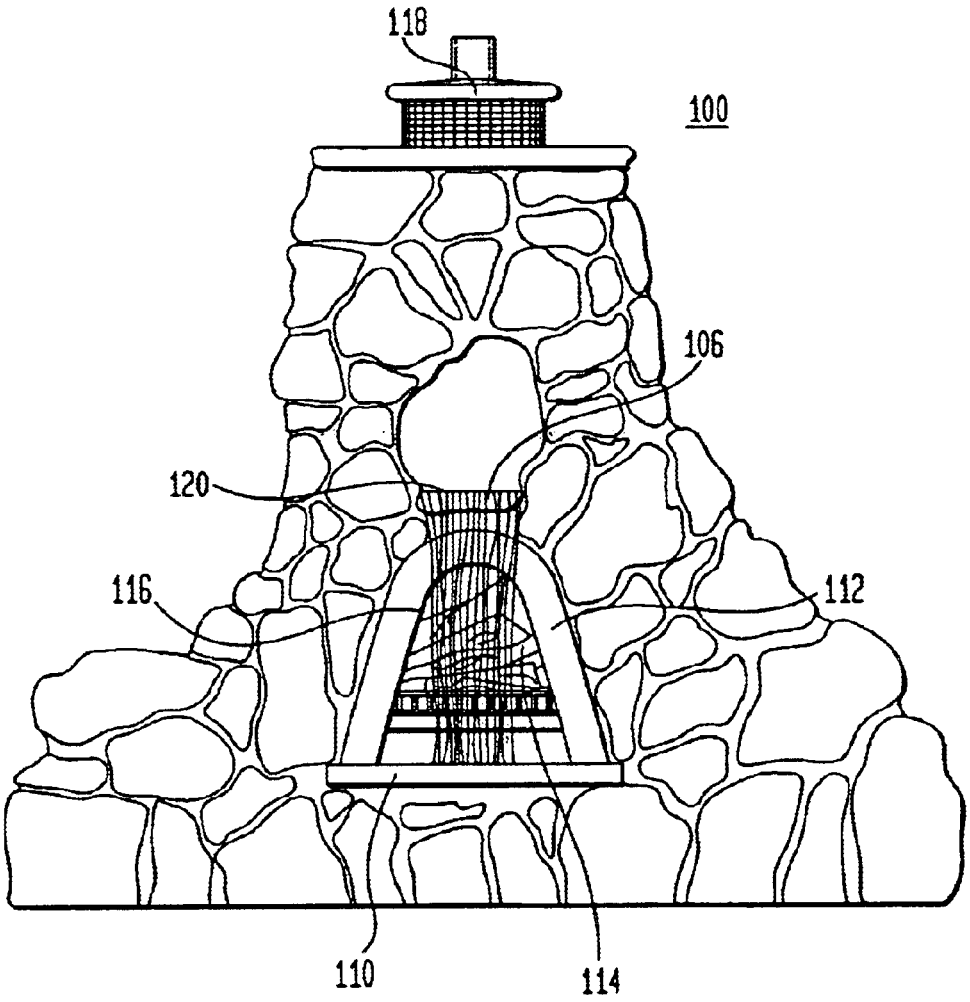
FIG. 1 is a planar front view of one embodiment of the fireplace of the present invention.

FIG. 1 shows an embodiment of a fireplace 100 of the present invention in which the fireplace 100 is freestanding. The fireplace 100 also may be an insert adapted for use with an existing conventional fireplace, or as shown more fully in FIG. 2, may be incorporated into or against a wall. The fireplace 100 preferably is a wood or coal burning fireplace, but alternatively may be a gas fireplace.

The fireplace 100 includes a fire box 112 having a front opening 116 and a means for producing flames, a trough 108 in front of or around the fire box 112, and a hood 106 positioned above the fire box 112 and trough 108. The means for producing flames preferably is wood 114, coal, or wood pellets, but alternatively may be a gas burner. The fireplace 100 preferably has a chimney 118 for removing smoke and gases produced by flames in the fire box 112, but alternatively may have a vent adapted for connecting the fire box 112 to an existing chimney or other means for removing smoke or gas.

The trough 108 preferably is positioned in front of the the front opening 116 of the fire box 112, but alternatively may extend around all or a portion of the fire box 112. The trough 108 collects water as it falls freely from an opening 120 in the hood 106. The trough 108 thus has a sufficient depth to collect and store water, and also is sufficiently deep to accommodate a plumbing assembly 302 which transports water from the trough 108 to the hood 106. A screen 304 preferably is positioned horizontally in the trough 108, such that water falling from the opening 120 in the hood 106 is dispersed as it enters the trough 108. In a preferred embodiment, the screen 304 is positioned in the trough 108 at a height at or near the water level in the trough 108 while the plumbing assembly 302 is in operation. However, the screen 304 may be used at any height, but in order to dissipate the splash the screen 304 must be positioned at or just slightly above the water level.

The plumbing assembly 302 preferably includes piping 306 connecting the trough 108 to the opening 212 in the hood 106, and a pump 308 for forcing water from the trough 108 upward through the piping 306 and through the opening 120 in the hood 106. As discussed above, the hood 106 has an opening 120, and is positioned above the fire box 112. Alternatively, the hood 106 may have two or more openings 120. The hood 106 preferably extends out from the fire place 100 a predefined distance beyond the front opening 116 of the fire box 112. As a result, water pumped up to the hood 106 from the trough 108 by the plumbing assembly 302 falls freely, or "free falls," from the hood 106 back into the trough 108. The distance by which the hood 106 extends out from the fire place 100 may be varied depending on how much distance one desires to keep between the falling water and the front opening 116 of the fire box 112. In an alternative embodiment, the fire box 112 may be recessed and the hood 106 may be generally flush with the front of the fireplace 100. In this embodiment, the water will not free fall, but instead will flow down the front face of the fire place 100 and into the trough 108. The water remains in front of the flames, however, because the fire box 112 is recessed in the fire place 100. The hood 106, fire box 112, and trough 108 may be of any shape including, but not limited to, square, rectangular, round, or octagonal. As shown in FIG. 1, the fireplace 100 may be ornamental having a front face made of stone, or as shown in FIG. 2, the fire place 100 may have a more utilitarian appearance.

Figure 2:
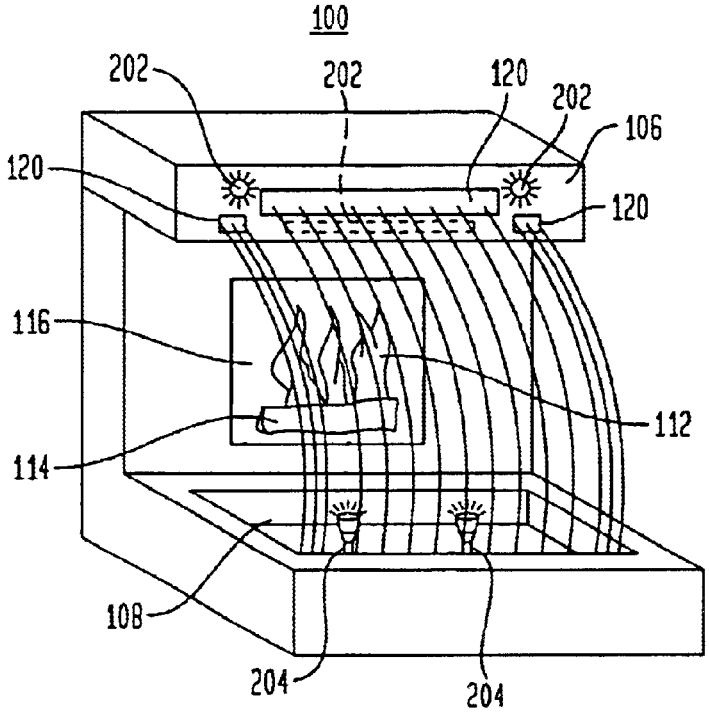
FIG. 2 is a perspective front view of an alternative embodiment of the fireplace of the present invention.

FIG. 2 shows an alternative embodiment of the fireplace 100 of the present invention in which the fireplace 100 is adapted for use with a wall. The hood 106 and trough 108 are generally square shaped. The trough 108 is positioned in front of the front opening 116 of the fire box 112, and the hood 106 extends out away from the fireplace 100 and over the trough 108. As a result, the water free falls from the hood 106 into the trough 108. The hood 106 has an elongated horizontal opening 120 through which water that has been transported from the trough 108 via the plumbing assembly 302 flows. This alternative embodiment of the fireplace 200 uses the same basic plumbing assembly discussed above and shown more clearly in FIG. 3.

Figure 3:
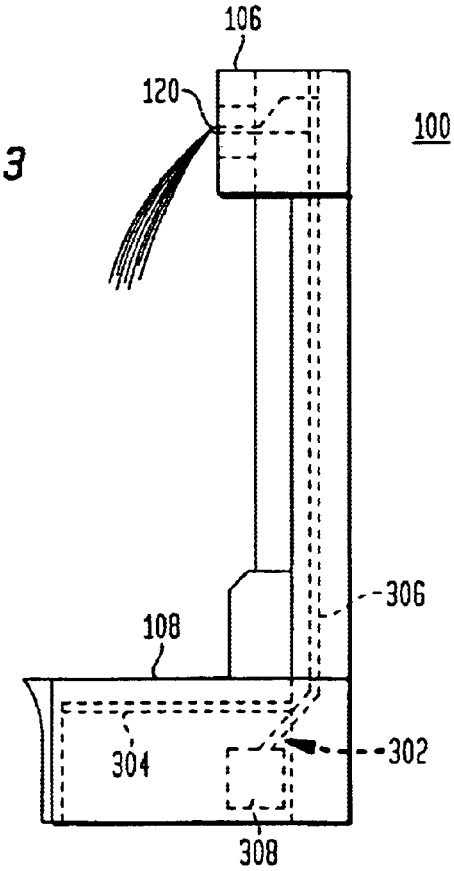
FIG. 3 is a planar side view of an embodiment of the fireplace of the present invention.

FIG. 3 shows an embodiment of the plumbing assembly 302 within the fireplace 100. The plumbing assembly 302 includes piping 306 and one or more pumps 308. The pump 308 operates to pump water from the trough 108 upwardly through the piping 302 and into and through the opening 120 in the hood 106. One or more spouts or nozzles may be positioned on the upper end of the piping 306 near the opening 120 to provide the desired trajectory of the water as it exits the opening 120. The horizontal placement of the screen 304 also is shown in FIG. 3. As discussed above, the screen 304 causes the falling water to disperse on contact thereby preventing the water from splashing up and in to the flames in the fire box 112. In order for the screen 304 to function properly, it must be positioned at or just slightly above the level at which the water is maintained in the trough 108.

The fireplace 100 may include one or more lights mounted in various locations for decorative purposes. For example, colored lights 204 may be mounted under the water contained in the trough 108, or alternatively, lights 202 may be mounted near the opening 120 of the hood 106, or on a surface of the hood 106. Multiple spouts having different angles and/or different heights also may be mounted in one or more openings 120 thereby changing the trajectory of the water as it flows over the hood 106.

In operation, the fireplace 100 of the present invention may be either stand-alone or it may incorporated with or inserted into an existing fireplace. Water in the trough 108 is forced by the pump 308 of the plumbing system 302 upward through the piping 306. The piping 306 ends at or near the opening 120 in the hood 106. Depending on the desired configuration, the opening 120 may be in the hood 106 itself such that water flows out from the hood 106, or the opening 120 may be above the hood 106 such that water flows from the opening 120 and onto and over the hood 106. One or more spouts or nozzles also may be positioned at the end of the piping 306 to control the trajectory of the water flow as it exits the piping 306. Likewise, the hood 106 may have two or more openings 120 for changing the path of water flow from the hood 106.

Upon exiting the piping 306, water flows from the opening 120, and depending on the configuration, either out of or over the hood 106. Because the hood 106 preferably extends out and away from the front of the fireplace 100 and beyond the front opening 116 of the fire box 112, the water free flows down into the trough 108. "Free flow" means that the water does not contact the front surface of the fireplace 100, i.e., there is no surface tension between the water and fireplace 100, instead gravity is the only force (other than internal surface tension) being applied to the water as it falls from the hood 106 to the trough 108. The water contacts the screen 304 positioned horizontally in the trough 108 and is dispersed upon contact. As a result, the water does not splash up and into the fire box 112. Once the water lands in the trough 108, it is cycled through the process again by the plumbing system 302. While the water is being cycled from trough 108 to hood 106 and back again, flames are produced in the fire box 112 by burning wood, coal, wood pellets, or other means for producing flames known to one of skill in the art. As a result, an aesthetically pleasing fireplace 100 having a waterfall is produced.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

What is claimed is:

1. A fireplace, comprising:

a fire box having a front opening and a means for producing flames;

a trough positioned in front of said front opening of said fire box, and having a screen positioned horizontally therein;

a hood having an opening, and being positioned above said fire box and extending forward a predefined distance in front of said front opening of said fire box such that water falls freely from said opening in said hood into said trough through said screen; and a plumbing assembly connecting said trough with said opening in said hood, wherein said plumbing assembly transports water from said trough to said opening in said hood.

2. The fireplace of claim 1, further comprising one or more lights mounted in said trough.

3. The fireplace of claim 1, further comprising one or more lights mounted near said opening in said hood.

4. The fireplace of claim 1, further comprising one or more lights mounted on a front surface of said hood.

5. The fireplace of claim 1, further comprising a chimney connected to said fire box for removing smoke and gases from the fireplace.

6. The fireplace of claim 1, wherein said trough is positioned around said fire box.

7. The fireplace of claim 1, wherein said means for producing flames is selected from the group consisting of wood, coal, wood pellets, and a gas burner.

8. The fireplace of claim 1, wherein said plumbing assembly comprises a pump for forcing water upward from said trough to said hood.

9. The fireplace of claim 1, wherein said plumbing assembly comprises piping connecting said trough to the opening in said hood.

10. The fireplace of claim 9, further comprising one or more nozzles connected to the piping near the opening in said hood.

11. The fireplace of claim 9, further comprising two or more nozzles connected to the piping near the opening in said hood.

12. The fireplace of claim 1, further comprising two or more openings in said hood.

13. The fireplace of claim 1, wherein the water is maintained in said trough at a water level and said screen is positioned in said trough at a height at or near the water level.

14. The fireplace of claim 1, wherein the water is maintained in said trough at a water level and said screen is positioned in said trough at a height above said water level.

* * * * *